US009915419B2

(12) United States Patent
Potucek et al.

(10) Patent No.: US 9,915,419 B2
(45) Date of Patent: Mar. 13, 2018

(54) LIGHT WITH EXPANDING COMPRESSION MEMBER

(71) Applicant: Hayward Industries, Inc., Elizabeth, NJ (US)

(72) Inventors: Kevin L. Potucek, Far Hills, NJ (US); James Carter, Warren, RI (US); Gregory Fournier, West Kingston, RI (US); James Murdock, Wakefield, RI (US); Steven Mitchell, Chepachet, RI (US); Douglas Sawyer, Jr., Seekonk, MA (US); Matt Williamson, Providence, RI (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 14/500,307

(22) Filed: Sep. 29, 2014

(65) Prior Publication Data

US 2015/0092416 A1 Apr. 2, 2015

Related U.S. Application Data

(60) Provisional application No. 61/883,693, filed on Sep. 27, 2013.

(51) Int. Cl.
*F21V 31/00* (2006.01)
*F21V 23/00* (2015.01)
(Continued)

(52) U.S. Cl.
CPC ..... *F21V 31/005* (2013.01); *F21V 21/047* (2013.01); *F21V 23/006* (2013.01);
(Continued)

(58) Field of Classification Search
CPC ..... F21V 31/005; F21V 5/048; F21V 29/20; F21V 21/047; F21W 2131/401
See application file for complete search history.

(56) References Cited

U.S. PATENT DOCUMENTS 3,584,504 A 6/1971 Proctor et al.
4,382,383 A 5/1983 de Buda et al.
(Continued)

FOREIGN PATENT DOCUMENTS

FR 2935459 A1 3/2010
WO 2007/053654 A2 5/2007

OTHER PUBLICATIONS

International Search Report of the International Searching Authority mailed on Mar. 3, 2015, issued in connection with International Application No. PCT/US14/58068 (5 pages).
(Continued)

*Primary Examiner* — Karabi Guharay
(74) *Attorney, Agent, or Firm* — McCarter & English, LLP

(57) ABSTRACT

A light includes a body, a front housing secured to a front end of the body, a translating retainer rotatably engaged with the front housing, a slip ring positioned around the front housing and between the translating member and the front end of the body, a compressible ring positioned around the front housing and between the slip ring and the front end of the body, a lens mounted to the front housing, an electronic assembly, and a light emitting element in electrical communication with the electronic assembly and positioned within the lens. Rotation of the translating retainer in a first direction causes the translating retainer to drive the slip ring toward the front end of the body, compressing the compressible ring and causing the compressible ring to bulge outward
(Continued)

to contact, and removably engage, an inner wall of a pipe or conduit that the light is positioned in.

108 Claims, 11 Drawing Sheets

(51) Int. Cl.

| | |
|---|---|
| ***F21V 21/04*** | (2006.01) |
| *F21W 131/401* | (2006.01) |
| *F21Y 115/10* | (2016.01) |
| *F21V 29/71* | (2015.01) |
| *F21V 29/83* | (2015.01) |

(52) U.S. Cl.
CPC ..... *F21V 29/717* (2015.01); *F21V 29/83* (2015.01); *F21W 2131/401* (2013.01); *F21Y 2115/10* (2016.08)

(56) References Cited

U.S. PATENT DOCUMENTS

| | | | | |
|---|---|---|---|---|
| 4,574,337 | A | 3/1986 | Poppenheimer | |
| 5,195,392 | A | 3/1993 | Moore et al. | |
| 6,820,653 | B1 | 11/2004 | Schempf et al. | |
| 8,586,881 | B1 * | 11/2013 | Shemtov | F16L 19/061 174/652 |
| 2002/0080624 | A1 | 6/2002 | Koren | |
| 2005/0036305 | A1 | 2/2005 | Kersey | |
| 2005/0088843 | A1 | 4/2005 | Chapman | |
| 2007/0268702 | A1 * | 11/2007 | McFadden | F21V 29/004 362/294 |
| 2011/0276193 | A1 * | 11/2011 | Bowman | H05B 37/029 700/295 |
| 2012/0033415 | A1 | 2/2012 | Sharrah et al. | |
| 2012/0113654 | A1 | 5/2012 | Dai | |
| 2013/0100651 | A1 | 4/2013 | Doyle | |

OTHER PUBLICATIONS

Written Opinion of the International Searching Authority mailed on Mar. 3, 2015, issued in connection with International Application No. PCT/US14/58068 (5 pages).

Supplementary Partial European Search Report issued by the European Patent Office in connection with European Patent Application No. EP14848231, dated Apr. 10, 2017 (14 pages).

Extended Supplementary European Search Report issued by the European Patent Office in connection with European Patent Application No. EP14848231, dated Aug. 31, 2017 (15 pages).

* cited by examiner

LIGHT WITH EXPANDING COMPRESSION MEMBER

RELATED APPLICATIONS

The present application claims the benefit of priority to U.S. Provisional Application No. 61/883,693, filed Sep. 27, 2013, which is incorporated herein by reference in its entirety.

BACKGROUND

Field of the Disclosure

The present disclosure relates generally to a light for installation in a pipe or a conduit. More specifically, the present disclosure relates to a light for installation in a pipe or conduit that includes a compressible ring that expands when compressed and creates a waterproof seal with the pipe or conduit when the light is installed therein.

Related Art

In the underwater lighting field, submersible lights are known and commonly used. Pool and spa owners often install pool/spa lights in order to add ambiance to the pool/spa setting. For example, submersible lights are often installed along the perimeter of a pool, both above and below the water line, in order to illuminate the pool at night. Furthermore, some pool or spa owners install a plurality of submersible lights that are connected with a control system for generating a light show. However, conventional pool/spa lights often require the installation of a niche in the pool/spa wall. To install the niche, a portion of the pool/spa must often be removed. The installation of the niche is an additional expense, as well as an irreversible change to the pool/spa wall.

In view of the foregoing, it would be desirable to provide an underwater light that is adapted for installation in a pipe or conduit without requiring installation of a niche in the pool or spa wall.

SUMMARY

The present disclosure relates generally to a light for installation in a pipe or conduit. The light includes a body having a front end and a rear end, a front housing secured to the front end of the body, a translating retainer rotatably engaged with the front housing, a slip ring positioned around the front housing and between the translating member and the front end of the body, a compressible ring positioned around the front housing and between the slip ring and the front end of the body, a lens mounted to the front housing, an electronic assembly for controlling the light, and a light emitting element in electrical communication with the electronic assembly and positioned within the lens. The compressible ring is formed of an elastic and waterproof material. Rotation of the translating retainer in a first direction causes the translating retainer to drive the slip ring toward the front end of the body, compressing the compressible ring between the slip ring and the front end of the body, and causing the compressible ring to bulge outward and contact an inner wall of a pipe or conduit into which the light is positioned, thereby removably engaging the pipe or conduit.

The present disclosure further relates to a light that includes a body having a front end and a rear end, a lens coupled to, and defining a waterproof chamber with, the body, an electronic assembly mounted in the waterproof chamber, and means for mounting the light to an inner surface of a conduit, the conduit including an electrical cable for supplying electrical current to the light. The electronic assembly including at least one light-emitting element for emitting light.

BRIEF DESCRIPTION OF THE DRAWINGS

The foregoing features of the disclosure will be apparent from the following Detailed Description, taken in connection with the accompanying drawings, in which.

DETAILED DESCRIPTION

The present disclosure relates to a light including an integral expanding compression member for installation in, and sealing with, a pipe, as discussed in detail below in connection with FIGS. 1-11. As used herein, the term "pipe" refers to pipes, conduits, fixtures, and/or other components in a pool or spa setting which are physically capable of receiving the light of the present disclosure, and which include, but are not limited to, fluid pipes/conduits, electrical pipes/conduits, architectural fixtures, etc.

Figure 1:
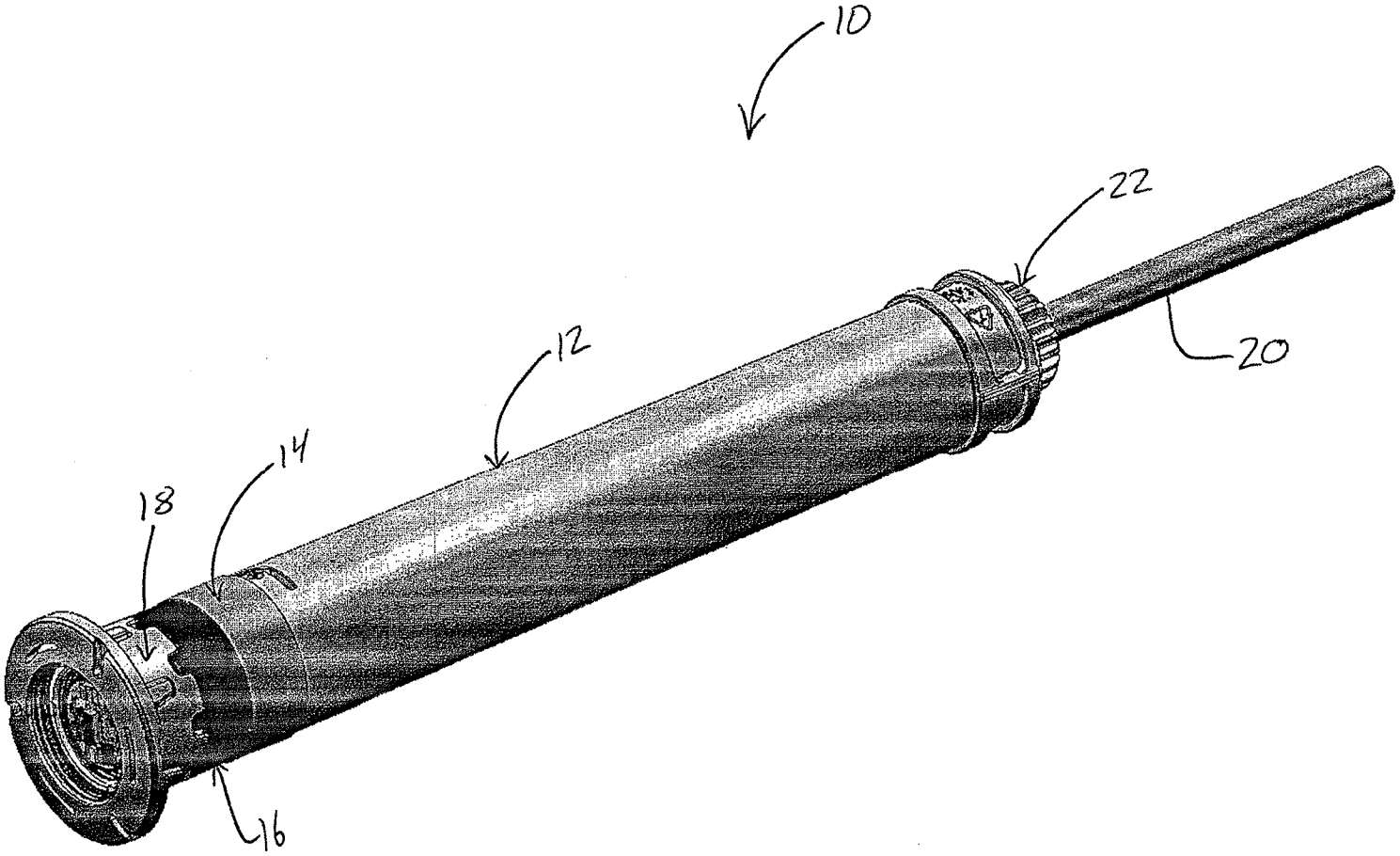
FIG. 1 is a perspective view of the light of the present invention.
Figure 2:
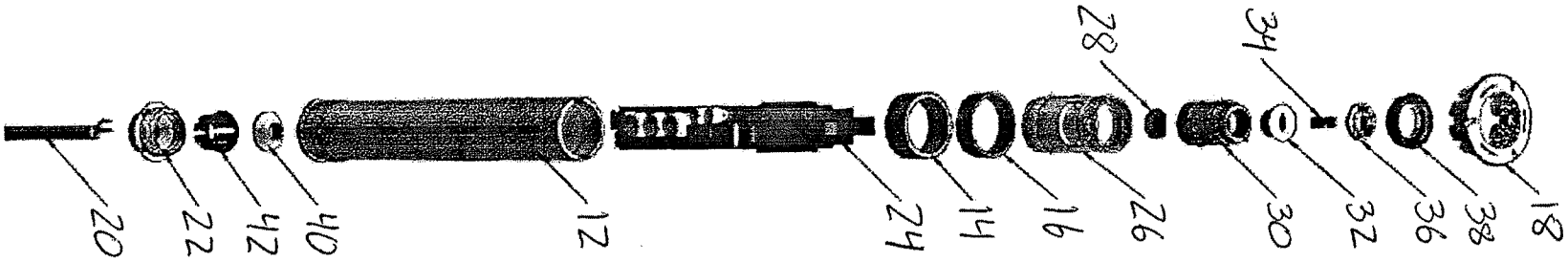
FIG. 2 is an exploded view of the light.
Figure 3:
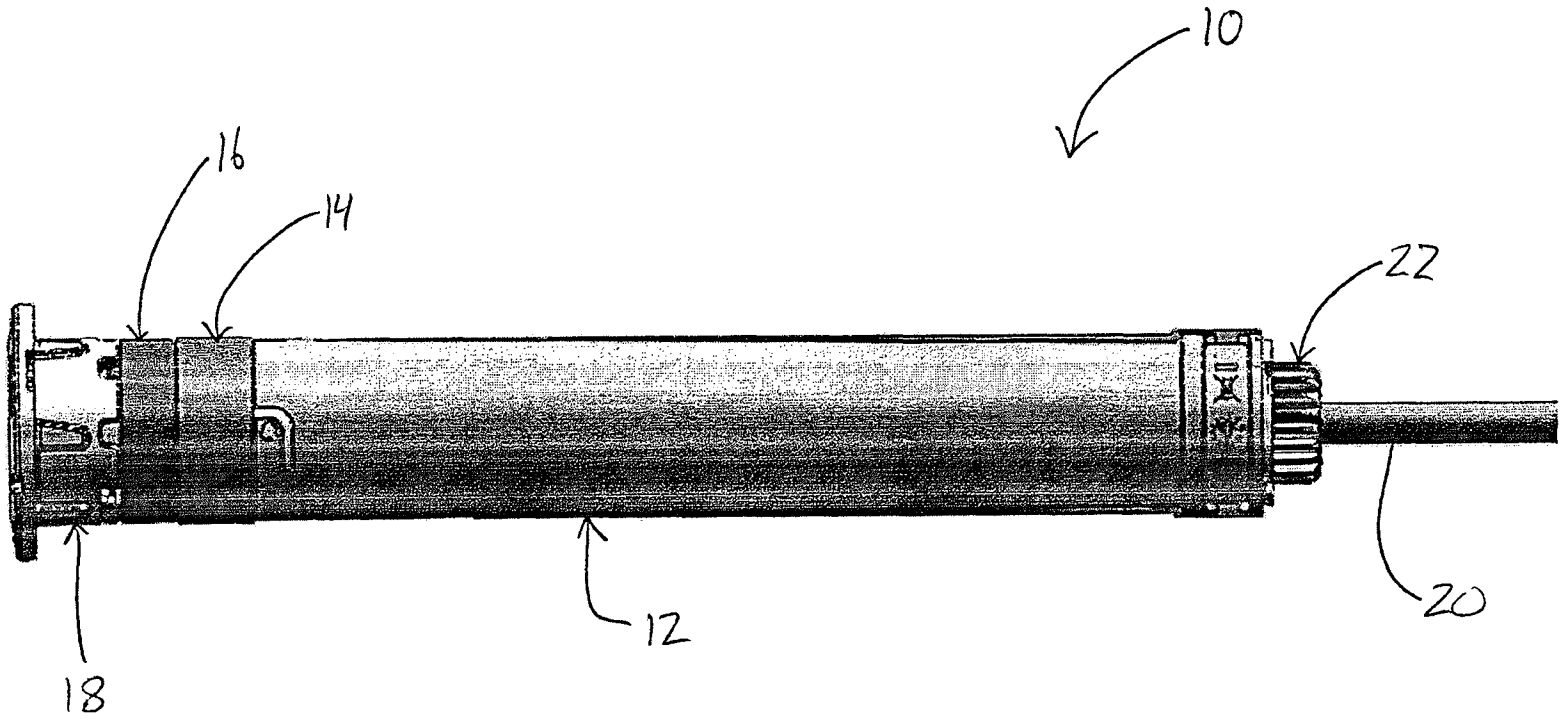
FIG. 3 is a side view of the light showing the compression ring uncompressed.

FIGS. 1-7 show the light 10 of the present invention in detail. FIG. 1 is a perspective view of the light 10. As can be seen in FIGS. 1 and 3, the light 10 includes a body 12, a compression ring 14, a slip ring 16, a translating bezel or retainer 18, a cable 20, and a cable retainer 22. FIG. 2 is an exploded view of the light 10, showing the components thereof, including those housed in the body 12. Specifically, the light 10 additionally includes a plurality of internal components including a printed circuit board (PCB) 24, a front housing 26, a bridge PCB 28, a plastic heatsink 30, a metal heatsink 32, a bridge connector 34, a light emitting diode (LED) board assembly 36, and a lens 38. The light 10 further includes a cable grommet 40 and cable grip 42 for securing the cable 20 to the body 12. The PCB 24 and the LED board assembly 36 can each include a plurality of printed circuit boards that can be mated using stand-off connectors, edge card connections, or flex tail connections.

Figure 4:
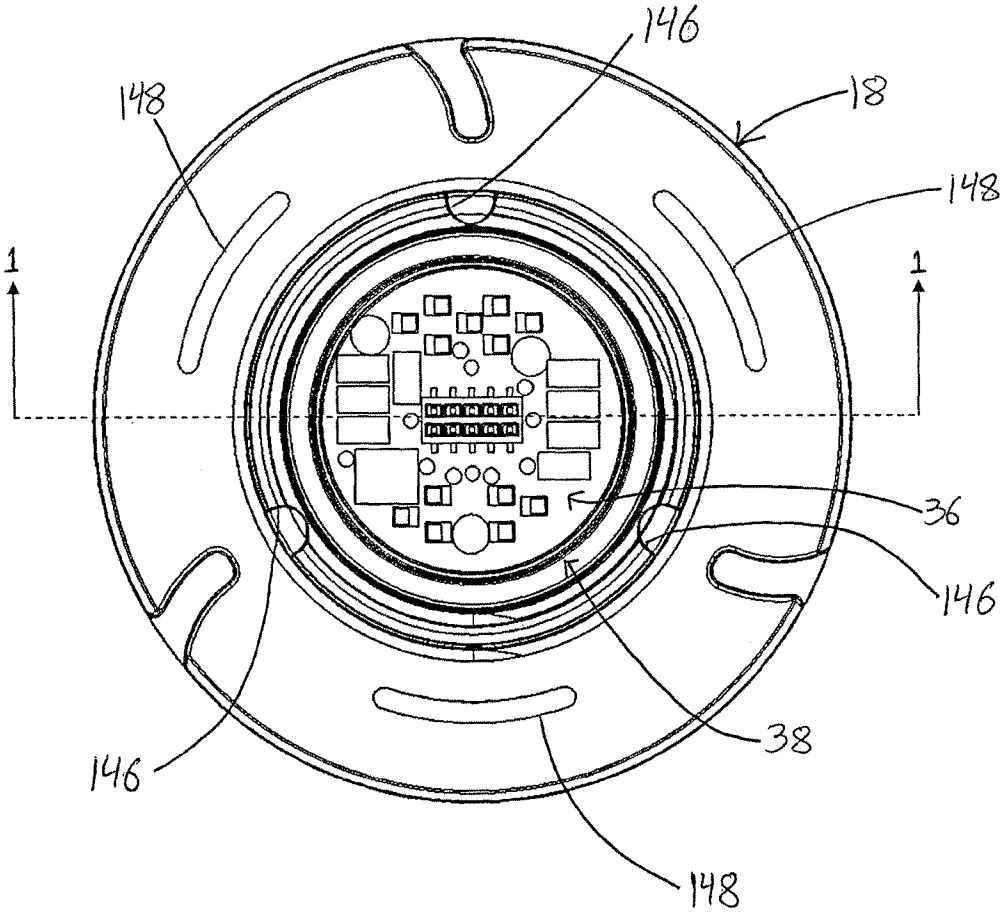
FIG. 4 is a front view of the light.
Figure 5:
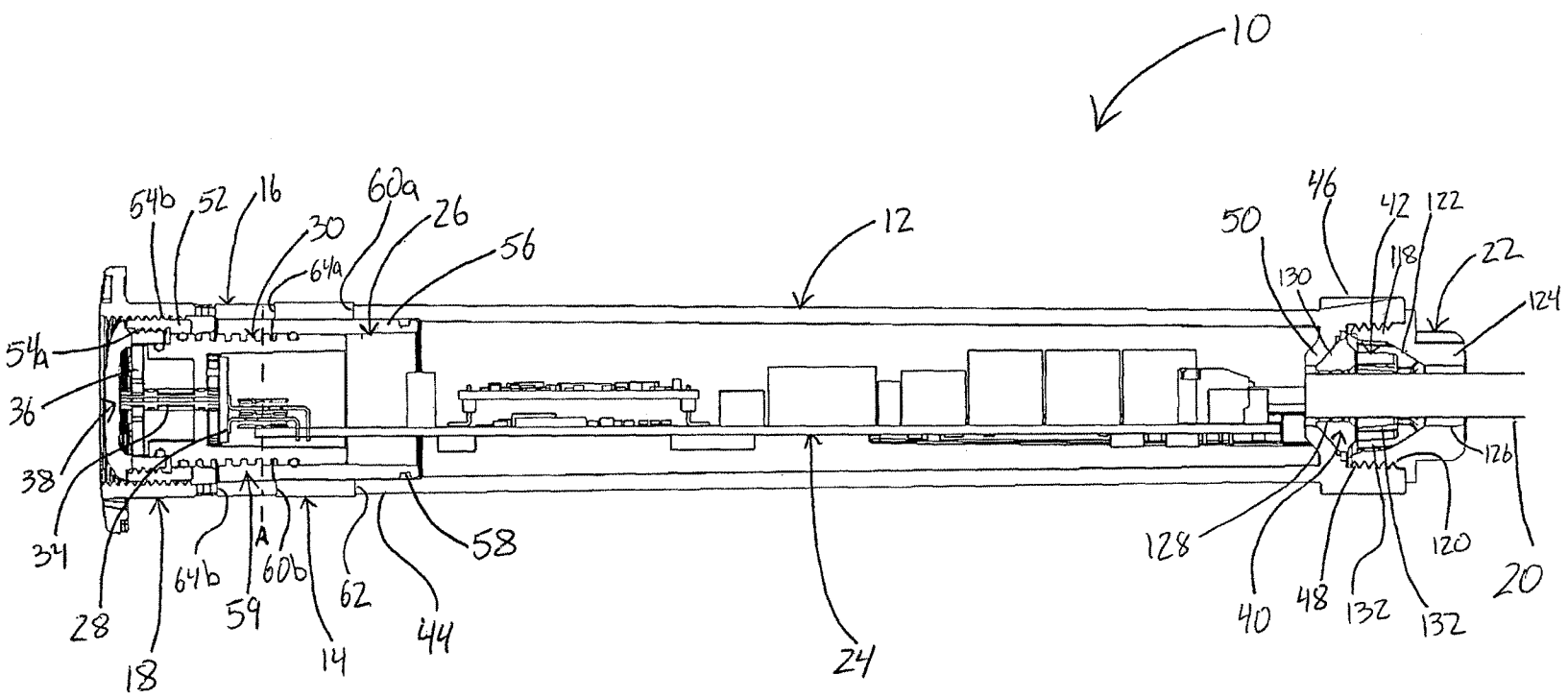
FIG. 5 is a sectional view of the light taken along line 1-1 of FIG. 4.
Figure 6:
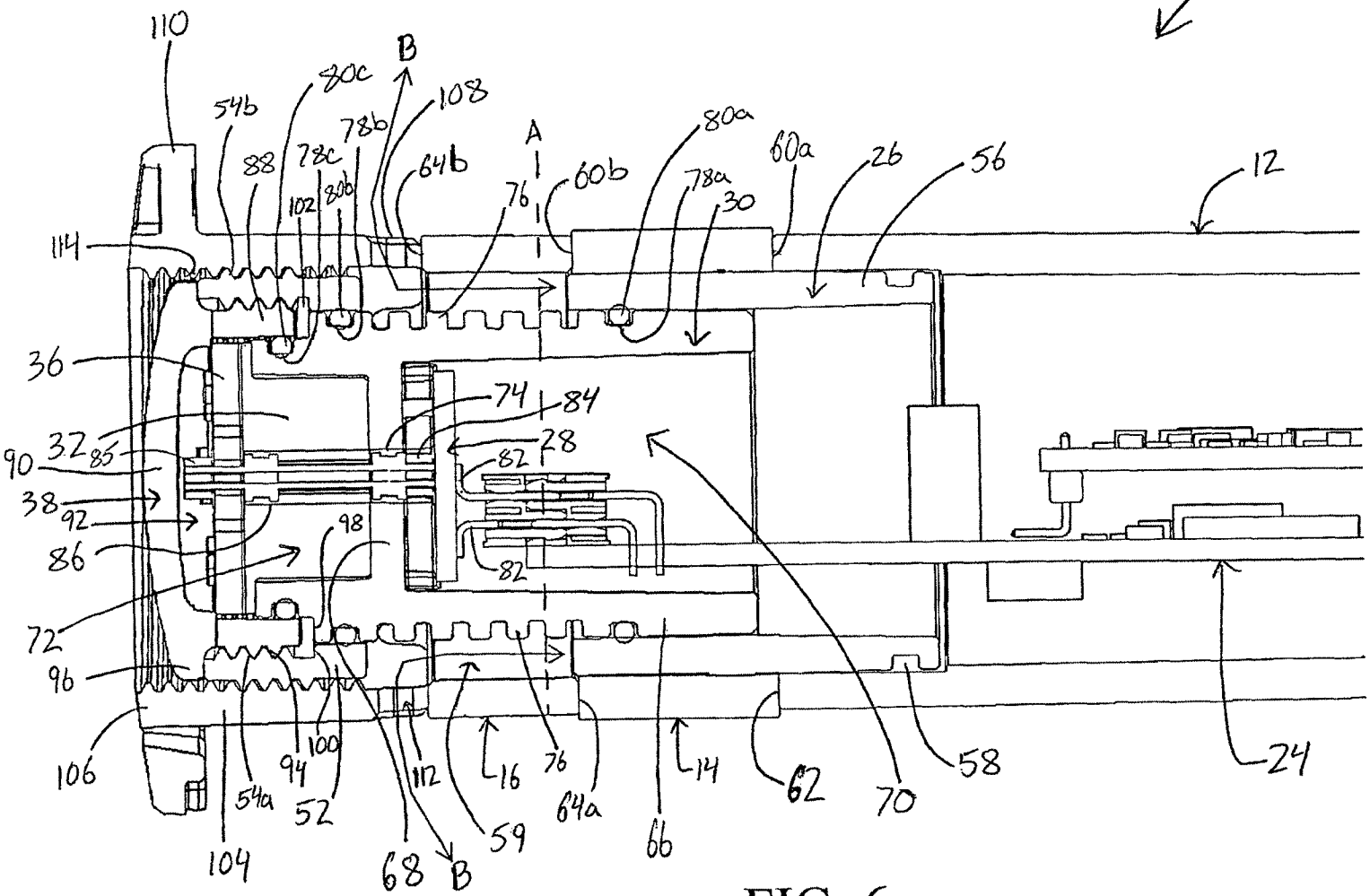
FIG. 6 is a partial sectional view of the light taken along line 1-1 of FIG. 4.

Referring to FIGS. 4-6, FIG. 5 is a sectional view of the light 10 taken along line 1-1 of FIG. 4. FIG. 6 is a partial sectional view of the light taken along line 1-1 of FIG. 4. The body 12 is generally a cylindrical tube that includes a front end 44 and a rear end 46. The rear end 46 includes internal threads 48 and an internal annular slanted retention wall 50. The front housing 26 includes a front end 52 having internal threads 54*a* and external threads 54*b*, and a rear end 56. The front housing 26 is sized to be inserted into the front end 44 of the body 12, with the rear end 46 secured to interior wall of the body 12 by an interface 58 that prevents rotation of the front housing 26 relative to the body 12. The interface 58 can be a snap fit mechanism, a friction fit, or a permanent fix such as glue or a weld. The locking mechanism 58 can additionally include an o-ring. The front housing 26 is secured to the body 12 such that the front end 52 front housing 26 extends beyond the front end 44 of the body 12. The front housing 26 also includes a plurality of windows (removed portions/apertures) 59 between the front end 52 and the rear end 56 (see also FIG. 7, discussed below). The windows 59 allow air and/or water to enter a portion of the front housing 26 for cooling purposes, which is discussed in greater detail with connection to the plastic heatsink 30. The air and/or water generally flows in the direction of Arrow B. It is noted that the heatsink 30 need not be manufactured from plastic, and indeed, could be made from a metallic material. The body 12 and the front housing 26 house the PCB 24, which is connected to and receives power and control commands from the cable 20. The PCB 24 can also include a wireless transceiver so that the light 10 can receive control commands wirelessly through the wireless transceiver.

The compression ring 14 is a cylindrical ring having first and second faces 60*a*, 60*b*, and the ring 14 is positioned around the front housing 26 and abuts a front surface 62 of the body 12. Accordingly, the compression ring 14 has an inner diameter that is greater than the outer diameter of the front housing 26 and less than the outer diameter of the body 12. As such, the first face 60*a* of the compression ring 14 engages the front surface 62 of the body front end 44. The compression ring 14 can be constructed of a compressible and waterproof material such as silicone, rubber, plastic, polyvinyl chloride (PVC), or polycarbonate, or a non-water based lubricant that does not deteriorate. In some aspects, the compression ring 14 can comprise a barbed element for mounting, an o-ring, a hollow o-ring, or an adhesive (e.g., a silicone based adhesive). The compression ring 14 can be configured to absorb expansion due to freezing water. The slip ring 16 is similar in shape and size to the compression ring 14, but is constructed out of a more rigid material. That is, the slip ring 16 is a cylindrical ring having first and second faces 64*a*, 64*b* that is configured to be positioned around the front housing 26 and abut the second face 60*b* of the compression ring 14, such that the compression ring 14 is positioned between the slip ring 16 and the body 12. The slip ring 16 has an inner diameter that is greater than the outer diameter of the front housing 26 and less than the outer diameter of the compression ring 14. As such, the first surface 64*a* of the slip ring 14 engages the second face 60*b* of the compression ring 14.

Figure 7:
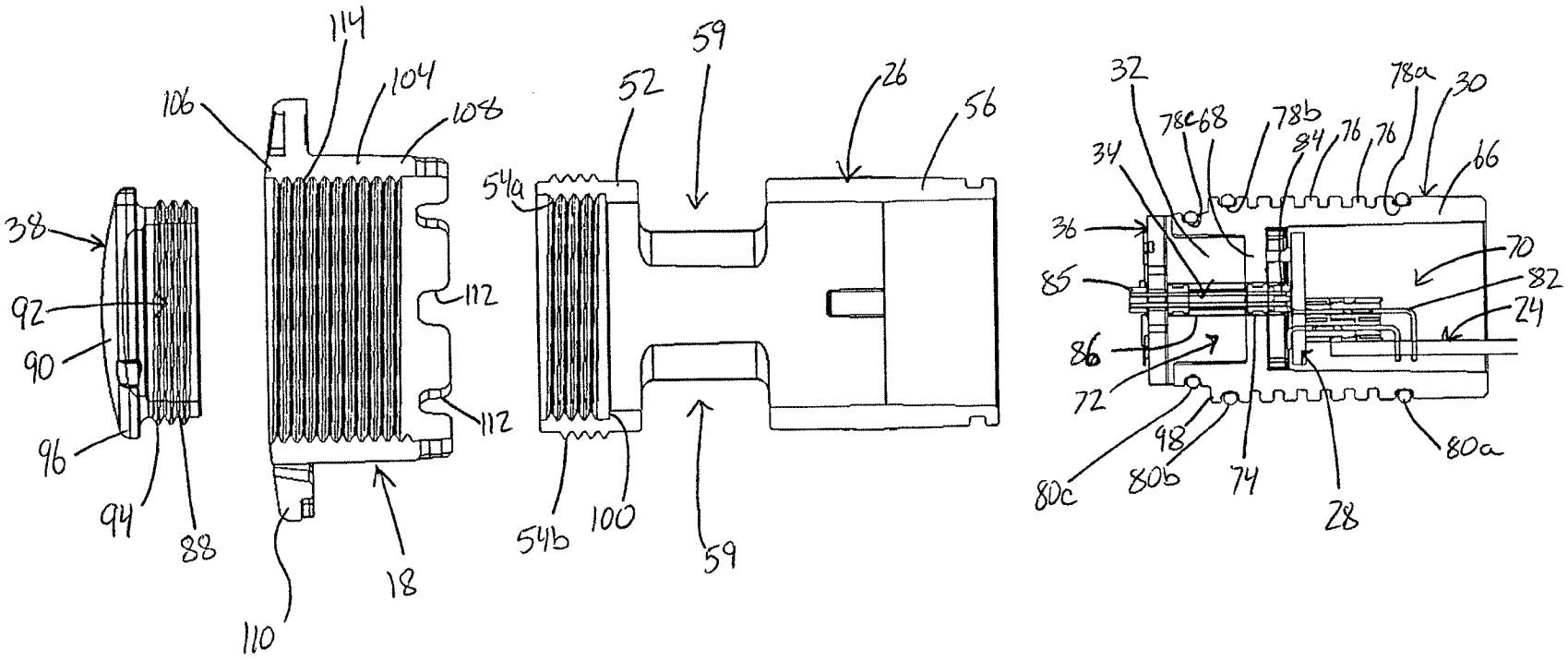
FIG. 7 is an exploded partial sectional view of the light taken along line 1-1 of FIG. 4.

Reference is now made to FIGS. 6 and 7 in connection with the plastic heatsink 30, the lens 38, the translating retainer 18, and various other components of the light 10, and their arrangement. FIG. 6 is a partial sectional view of the light 10 taken along line 1-1 of FIG. 4 showing the light 10 in greater detail. FIG. 7 is an exploded partial sectional view of the light 10 taken along line 1-1 of FIG. 4, showing the light 10 in greater detail. The plastic heatsink 30 is a tubular component having an outer wall 66 and an internal transverse wall 68. The plastic heatsink 30 defines a first chamber 70 and a second chamber 72 that are separated by the internal transverse wall 68. The internal transverse wall 68 includes an aperture 74 that allows communication between the first chamber 70 and the second chamber 72. The exterior of the plastic heatsink outer wall 66 includes a plurality of heat dissipating fins 76. The plastic heatsink outer wall 66 further includes a plurality of external circumferential o-ring chambers 78*a*, 78*b*, 78*c* that receives o-rings 80*a*, 80*b*, 80*c*, respectively. Two of the o-ring chambers 78*a*, 78*b* are positioned on opposite ends of the heat dissipating fins 76, such that the heat dissipating fins 76 are bound by the o-rings 80*a*, 80*b*. The plastic heatsink 30 is configured to be positioned within the front housing 26, such that the o-ring 80*b* is compressed between the plastic heatsink 30 and the front end 52 and the o-ring 80*a* is compressed between the plastic heatsink 30 and the rear end 56, each creating a seal therebetween. Accordingly, two of the o-rings 80*a*, 80*b* are positioned on opposite sides of the front housing windows 59, thus allowing air/water to flow along arrow B, that is, into the front housing 26 through the window 59 and along the heat dissipating fins 76, while preventing the air/water from entering the body 12 and damaging any electronics therein.

The plastic heatsink first chamber 70 houses the bridge PCB 28 and a portion of the PCB 24, while the plastic heatsink second chamber 72 houses the metal heatsink 32. The bridge PCB 28 is connected with a plurality of leads 82 extending from the PCB 24, such that the bridge PCB 28 is in electrical communication with the PCB 24. The leads 82 could include a connector that mates with a corresponding connection on the bridge PCB 28 during manufacturing of the light. This configuration allows the PCB 24 to be quickly connected with the bridge PCB 28. The bridge PCB 28 can be secured to the plastic heatsink 30 in the first chamber 70 by a snap-fit connector, or other connection means known in the art. The bridge PCB 28 includes a connector 84 that is connectable with the bridge connector 34. The metal heatsink 32 is positioned in the plastic heatsink second chamber 72, and includes a hole 86 that extends through the center. When the metal heatsink 30 is placed in the plastic heatsink second chamber 72 the hole 86 is aligned with the aperture 74 so that a continuous pathway is created. The LED board assembly 36 abuts the metal heatsink 30, and can be bonded thereto with a thermally conductive adhesive, for example.

The bridge connector 34 connects with the bridge PCB connector 84 and extends through the aperture 74 and into the second chamber 72 where it connects with the LED board assembly 36. The bridge connector 34, when connected with the bridge PCB connector 84 and the LED board assembly 36, places the two in electrical communication. This electrical connection further places the LED board assembly 36 in electrical communication with the PCB 24. Accordingly, power and control commands are transferred from the PCB 24, to the bridge PCB 28, across the bridge connector 34, and to the LED board assembly 36. The LED board assembly 36 includes circuitry and one or more LEDs 85 that are controlled by the PCB 24. The LED board assembly 36 can include LEDs 85 of different colors and intensity (e.g., red, green, and blue (RGB) LEDs, RGBW LEDs, white LEDs, or ultraviolet LEDs). The PCB 24 can control which LEDs are illuminated, for how long, and at what intensity. Moreover, it can create flashing patterns, light shows, etc. When the LEDs are illuminated, the LEDs themselves, along with the circuitry of the LED board assembly 36, the bridge connector 34, and the bridge PCB 28, generate heat, which is transferred through the metal heatsink 32, through the heat dissipating fins 76 of the plastic heatsink 30, and dissipated to any fluid that is adjacent the heat dissipating fins 76. This arrangement protects the circuitry of the light 10 from overheating and becoming damaged. The light 10 can also include a thermal management system in communication with the PCB 28 and the LED board assembly 36 that prevents operation of the PCB 10, LED board assembly 36, and the LEDs 85 mounted thereto at an operational temperature exceeding component limitations. Additionally, the light 10 can include a heat-pipe that conducts heat from the PCB 10, LED board assembly 36, and the LEDs 85 mounted thereto, and spreads the heat evenly throughout the light 10.

Additionally, when the cable 20, the PCB 24, the front housing 26, the bridge PCB 28, and the plastic heatsink 30 are connected, and the front housing 26 is secured to the body 12, the internal cavity of the light 10 can be filled with an epoxy resin (potting compound) from the portion of the PCB 24 that engages the cable 20 to a fill line A, illustrated in FIGS. 5 and 6. The epoxy resin fill is a thermally conductive, yet electrically non-conductive material, that permanently seals the PCB 24, the front housing 26, the plastic heatsink 30, and the body 12 together, such that the electrical components of the PCB 24 are encapsulated by the epoxy resin fill. Use of the epoxy resin fill ensures that the PCB 24 does not come in contact with water, and reduces the possibility of any of the electrical components of the PCB 24 breaking off from the PCB 24. Additionally, the epoxy resin fill functions to dissipate heat from the PCB 24.

The lens 38 includes a sidewall 88 and an upper portion 90 that together define an LED housing 92. The sidewall 88 includes external threads 94 on the outer surface thereof. The upper portion 90 includes a radial flange 96 that extends beyond the sidewall 88. The lens 38 is configured to be placed around the LED board assembly 36 and an upper portion of the plastic heat sink 30, such that the third o-ring 80*c* of the plastic heat sink 30 is compressed between an interior surface of the sidewall 88 and the o-ring chamber 78*c*. The lens 38 is also configured for the sidewall 88 to be inserted into the front end 52 of the front housing 26 and threadedly engaged with the interior threads 54*a* of the front housing 26. That is, the lens external threads 94 can engage the interior threads 54*a* of the front housing 26, such that rotation of the lens 38 will drive the lens sidewall 88 further into the front end 52 of the front housing 26. The plastic heat sink 30 can include an external shoulder 98 that extends radially outward, while the front end 52 of the front housing 26 can include an internal shoulder 100 that is adjacent the bottom-most interior thread 54*a* and extends radially inward. When the plastic heat sink 30 is inserted into the front housing 26, the external shoulder 98 and the internal shoulder 100 should be aligned such that a generally co-planar. The external shoulder 98 and the internal shoulder 100 can include an ultraviolet cured epoxy 102 applied thereto. The lens 38 can be placed over the LED board assembly 36 and a portion of the plastic heat sink 30, and rotated to engage the front housing interior threads 54*a* with the lens external threads 94. Continued rotation of the lens 38 drives the lens sidewall 88 toward the ultraviolet cured epoxy 102 until the bottom face of the lens sidewall 88 contacts the ultraviolet cured epoxy 102. Accordingly, the ultraviolet cured epoxy 102 can be compressed between the bottom face of the lens sidewall 88 and the external shoulder 98 and the internal shoulder 100, and cured with ultraviolet light, thus bonding the lens 38 with the plastic heat sink 30 and the front housing 26.

There are thus a plurality of preventative measures against the egress of fluid into the lens 38 (which houses the led board assembly 36) including the following: the second o-ring 78*b* compressed between the plastic heat sink 30 and the front housing 26, the ultraviolet cured epoxy 102, the threaded engagement of the lens 38 and the front housing 26, and the third o-ring 78*c* compressed between the lens sidewall 88 and the plastic heat sink 30. The first and second o-rings 78*b*, 78*c* are primary seals, while the threading and the ultraviolet cured epoxy 102 are secondary seals.

Figure 9:
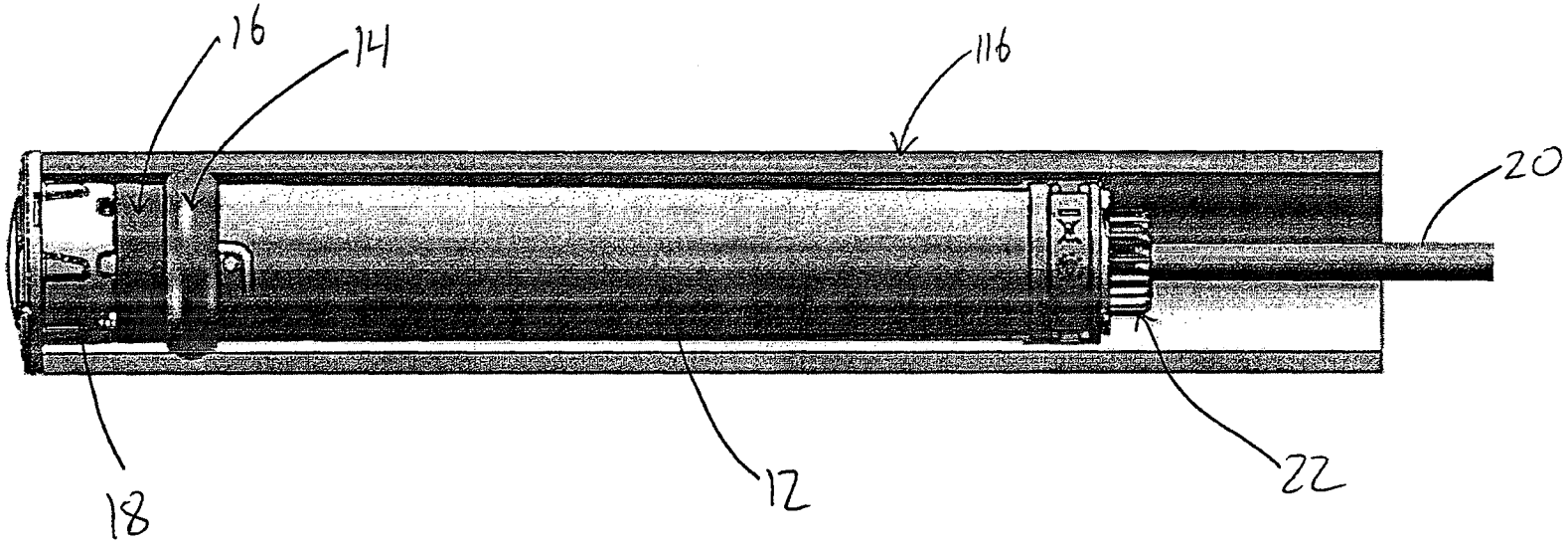
FIG. 9 is a partial sectional view of the light installed in a pipe.

The translating retainer 18 includes a cylindrical side wall 104 having a front end 106 and a rear end 108. A radial flange 110 extends from the front end 106 of the cylindrical side wall 104. The rear end 108 of the cylindrical side wall 104 includes a plurality of cut-outs 112 that allow fluid to flow from the exterior of the translating retainer 18 to the interior. More specifically, the cut-outs 112 allow for fluid to flow across the translating retainer 18, across the front housing 26 (e.g., across the windows 59), and across the heat dissipating fins 76 (as depicted by Arrows B). Additionally, the translating retainer 18 can be formed of a thermally conductive polymer, and can be in thermal communication with the heatsink 32 such that heat is transferred to the translating retainer 18 and to the water or air via the translating retainer 18. An interior surface of the cylindrical side wall 104 includes threads 114 configured to threadedly engage the external threads 54*b* of the front housing 26. The translating retainer 18 is configured to be placed around the front housing 26, and rotated to engage the front housing external threads 54*b*. Continued rotation of the translating retainer 18 drives the translating retainer 18 further along the front housing 26 and towards the slip ring 16. Once the front end 106 contacts the slip ring 16, continued rotation of the translating retainer 18 will cause the translating retainer 18 to drive the slip ring 16 toward the rear end 46 of the body 12, compressing the compression ring 14 between the slip ring 16 and the front end 44 of the body 12. This compression results in the compression ring 14 bulging outward, as illustrated in FIG. 5. When the light 10 is positioned in a pipe 116, as illustrated in FIG. 9, compression of the compression ring 14 between the slip ring 16 and the front end 44 of the body 12 causes the compression ring 14 to bulge outward and engage the inner surface of the pipe 116. The engagement of the bulging compression ring 14 with the inner surface of the pipe 116 secures the light 10 within the pipe 116 so that it cannot be removed unless the translating retainer 18 is loosened and the compression ring 14 is relieved of compression. The compression ring 14 can also form a watertight seal with the inner surface of the pipe 116. The compression ring 14 can be of different heights based on a required use or installation. Particularly, a compression ring 14 having a greater height will be capable of bulging out further and engaging the inner diameter of a larger pipe than a compression ring 14 having a lesser height. For example, a compression ring 14 having a first height can be used in a situation where the light 10 is being inserted into a 2.5" diameter pipe, while a compression ring 14 having a second height greater than the first height can be used in a situation where the light 10 is being inserted into a 3" diameter pipe. Additionally, the compression ring 14 can include abrasive teeth for increased pull-out resistance. It should be understood by one of ordinary skill in the art that the light 10 can be installed in a pipe positioned in a pool, landscaping, or buildings/architecture.

As mentioned above, the PCB 24 is connected with a cable 20 that provides power and control commands to the light 10. The cable 20 is secured to the light body 10 by the cable retainer 22, cable grommet 40, and cable grip 42, as shown in FIG. 5. The cable retainer 22 includes a sidewall 118 having external threads 120, an internal slanted wall 122, and a ridged head 124 having a central hole 126. The cable retainer 22 is configured to threadedly engage the internal threads 48 located at the rear end 46 of the body 12. The cable grommet 40 is a disk-like component having a central hole 128 and a slanted wall 130. The cable grip 42 is a ring-like component having a plurality of fingers 132. To secure the cable 20 to the light 10, the cable 20 is inserted through the cable retainer 22, the cable grip 42, the cable grommet 40, and into the body 12 where it is connected with the PCB 24. The cable retainer 22 is then threadedly engaged with the internal threads 48 of the body 12, which drives the cable grip fingers 132 against the slanted wall 122 of the cable retainer 22. The slanted wall 122 forces the cable grip fingers 132 inward so that they securely grip the cable 20. Additionally, further rotation of the cable retainer 22 drives the cable grip 42 into the cable grommet 40, causing the slanted wall 130 of the cable grommet 40 to engage the internal annular slanted retention wall 50 of the body 12. The internal annular slanted retention wall 50 of the body 12 directs the cable grommet 40 toward the cable 20, such that the cable grommet 40 is compressed against the cable 20 creating a seal therewith. When the cable retainer 22 is fully tightened, the cable retainer 22, the cable grommet 40, the cable grip 42, and the cable 20 create a watertight seal at the rear end 46 of the body 12.

Figure 8:
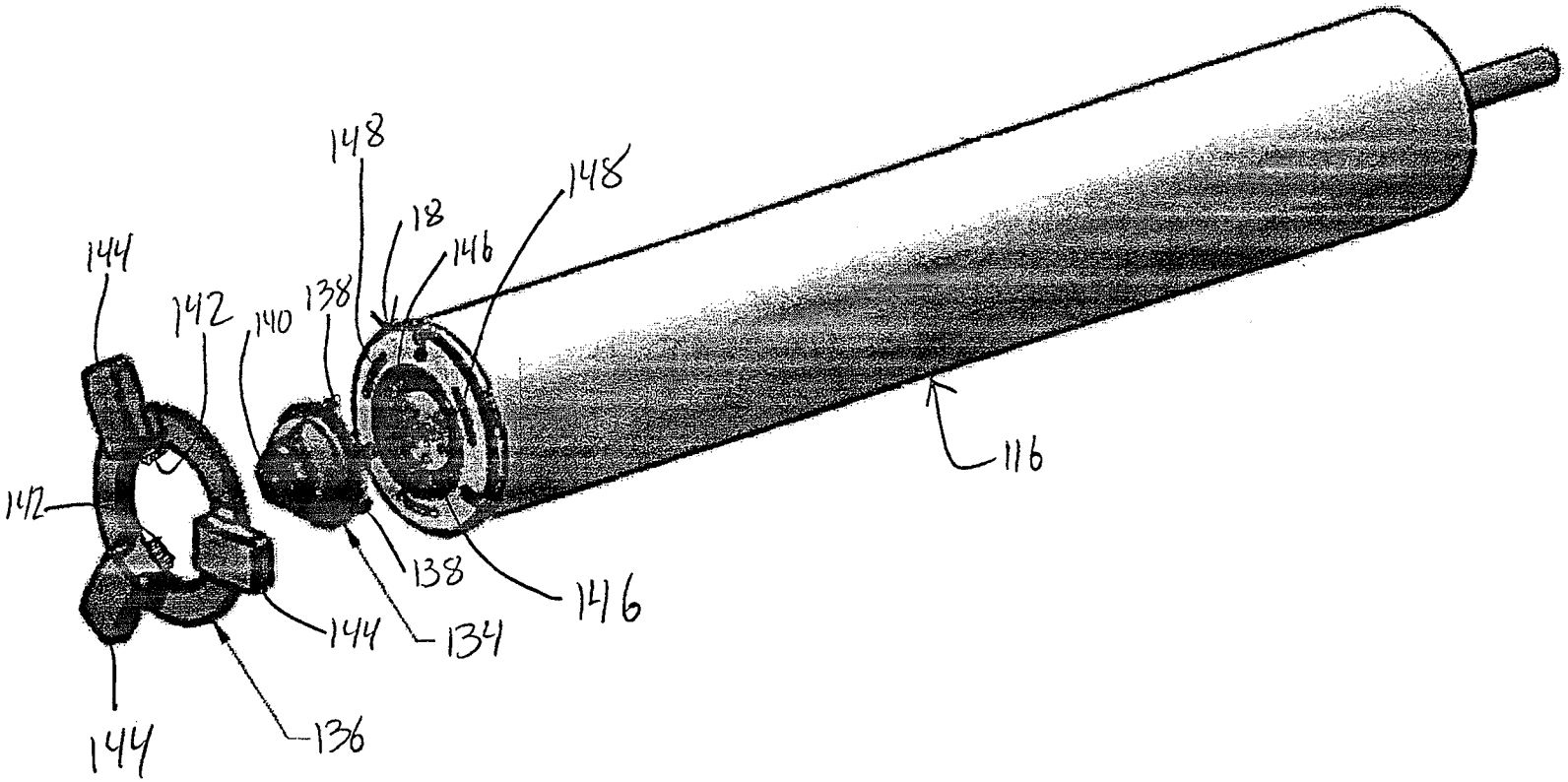
FIG. 8 is a perspective view of the light and associated tools for installing the light.

FIG. 8 is a perspective view showing tools that can be used for installing the light 10. A user may utilize a stationary removal tool 134 and a rotating removal tool 136 to tighten the translating retainer 18 and install the light 10 in a pipe 116. The stationary removal tool 134 includes a plurality of prongs 138 and a head 140. The rotating removal tool 136 includes a plurality legs 142 and a plurality of wings 144. As shown in FIG. 4 (which is a front view of the light 10), the lens 38 includes a plurality of apertures 146, and the radial flange 110 of the translating retainer 18 includes a plurality of slots 148. The rotating removal tool 136 is configured such that the plurality of legs 142 match in size and spacing with the plurality of slots 148 of the translating retainer 18, and can be inserted therein. Similarly, the stationary removal tool 134 is configured such that the plurality of prongs 138 match in size and spacing with the plurality of apertures 146 of the lens 38, and can be inserted therein. Alternatively, the translating retainer 18 and the lens 38 can be configured to be engageable with a pair of pliers, wrench, ratchet, drill, and/or a screwdriver.

To install the light 10, a user first pulls one end of the cable 20 through a pipe 116. The user then inserts the light 10 into the pipe 116 until the radial flange 110 of the translating retainer 18 contacts the end of the pipe 116, where the radial flange 110 covers the otherwise open end of the pipe 116. Next, the user connects the rotating removal tool 136 with the translating retainer 18, such that the plurality of legs 142 are inserted into the plurality of slots 148, and also connects the stationary removal tool 134 with the lens 38, such that the plurality of prongs 138 are inserted into the plurality of apertures 146. The stationary removal tool head 140 is then secured with a wrench, pair of pliers, socket wrench, or other gripping means, and held in place. This prevents the light 10 from rotating due to the engagement of the stationary removal tool head 140 with the lens 38, and the engagement of the lens 38 with the front housing 26. While securing the stationary removal tool 134, the user rotates the rotating removal tool 136 by engaging the wings 144. Rotation of the rotating removal tool 136 rotates the translating retainer 18, causing the translating retainer 18 to translate across the front housing 26 due to the engagement of the front housing external threads 54*b* with the translating retainer internal threads 114. During the rotation of the translating retainer 18, the lens 38, the front housing 26, the plastic heatsink 30, and the body 12 do not rotate because of their engagement with one another, and because the stationary removal tool 134 is secured in place with the lens 38. Continued rotation of the rotating removal tool 136, and thus rotation of the translating retainer 18, causes the translating retainer 18 to engage the slip ring 16 and drive the slip ring 16 against the compression ring 14. Further rotation results in the compression ring 14 being compressed between the slip ring 16 and the body 12, causing the compression ring 14 to bulge outward and eventually contact and bear against the pipe 116, creating a seal therewith. The light 10 is installed once the compression ring 14 is engaged with the pipe 116, as shown in FIG. 9, which is a partial sectional view showing the light 10 installed in a pipe 116. To uninstall the light 10, a user would simply loosen the translating retainer 18 by utilizing the rotating removal tool 136 and the stationary removal tool 134 in the same fashion just described. The light 10 can be installed in pipes of various sizes and materials, including 1.5" diameter PVC pipes, 55 mm diameter PVC pipes, etc.

Additionally, the radial flange 110 of the translating retainer 18 is configured to engage the front face of a pipe 116, as shown in FIG. 9. In such an instance, rotation of the translating retainer 18 will result in a pulling force on the front housing 26, and thus the body 12. This force will pull the body 12 towards the translating retainer 18, causing the body 12 to drive the compression ring 14 and the slip ring 16 toward the translating retainer 18 as well. Once the slip ring 16 contacts the translating retainer 18, the compression ring 14 starts to compress between the slip ring 16, and the body 12, because the body 12 is being pulled toward the translating retainer 18 due to the mechanical forces being implemented through rotation of the translating retainer 18. In such an arrangement, the translating retainer 18 remains in place against the front face of the pipe 116 and pulls the body 12 toward it. Alternatively, the lens 38 can be rotated using the stationary removal tool 134, while the translating retainer 18 can be held in place with the rotating removal tool 136, or by bonding with the front face of the pipe 116.

Furthermore, the radial flange 110 can be provided with a tapered geometry such that a central portion of the radial flange 110 has a greater thickness than an outer portion of the radial flange 110. Accordingly, the radial flange 110 extends radially from an increased thickness portion to a decreased thickness portion. In such an arrangement, the edge of the radial flange 110 can be at such a reduced thickness that it will lie flush with the pool/spa wall when fully inserted.

Figure 10:
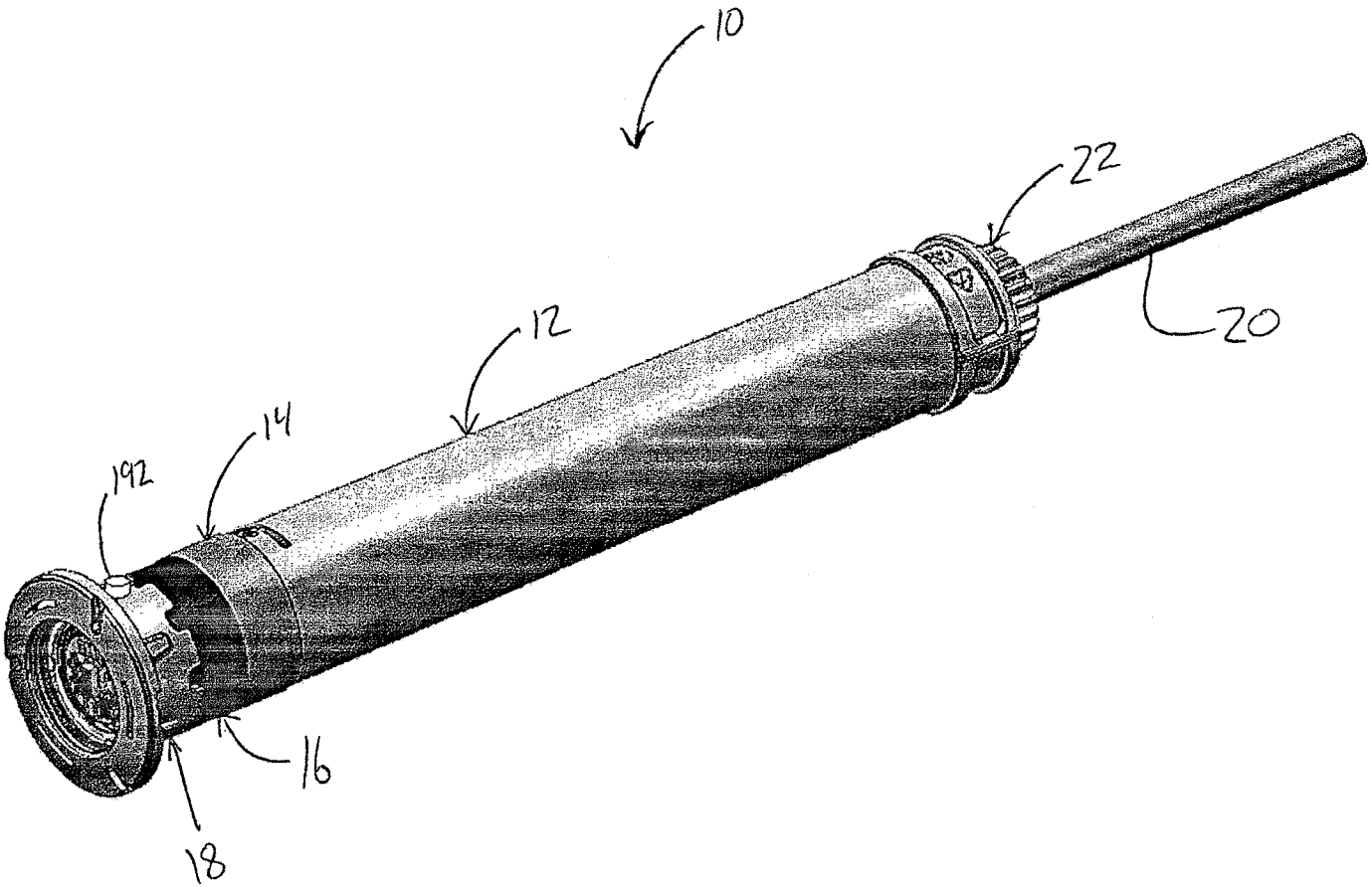
FIG. 10 is a perspective view of the light with a bayonet pin.
Figure 11:
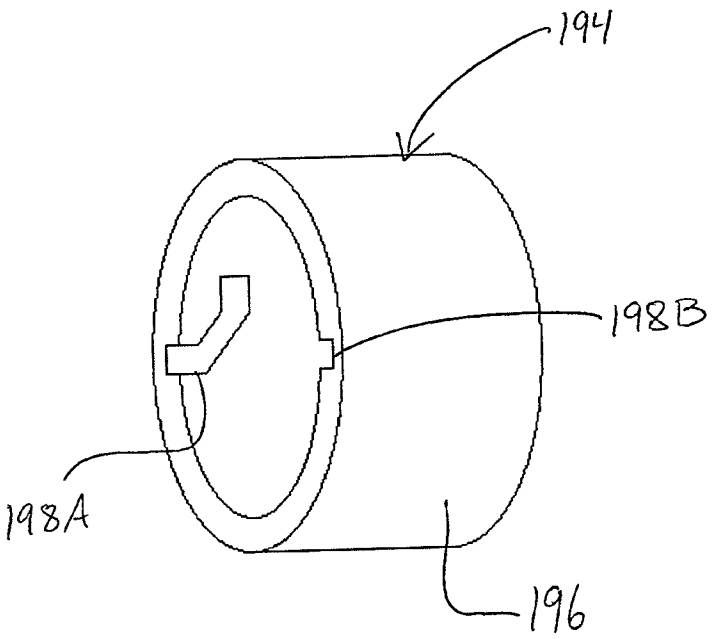
FIG. 11 is a perspective view of a collar for engaging with the light of FIG. 10.

FIGS. 10-11 illustrate another embodiment of the light 10 wherein a bayonet-type of connection is provided. FIG. 10 is a perspective view of the light 10 with a bayonet pin 192 provided on the translating bezel 18. FIG. 11 is a perspective view of a collar 194. The collar 194 includes a body 196 and a first and second track 198A, 198B formed on the inner wall of the body 196. The collar 194 can be inserted into the pipe 116, and secured to the end of the pipe 116 with glue. The collar 194 allows the light 10 to be captured in the pipe 116 in a particular orientation. That is, the tracks 198A, 198B are bayonet tracks, such that the light 10 can be inserted into the collar 194 and the pin 192 inserted into one of the tracks 198A, 198B. Once the pin 192 is positioned in one of the tracks 198A, 198B, the light 10 can be rotated to cause the pin to slide within the track 198A, 198B, pulling the light 10 further into the collar 194, and securing the light 10 to the collar 194. It should be understood by one of ordinary skill in the art that the light 10 can include one or more pins, while the collar 194 can include a single track or multiple tracks as illustrated. It is additionally contemplated that instead of a pin the light 10 can include male threading, while the collar 194 includes female threading instead of the tracks. In such a configuration, the light 10 can be screwed into the collar 194 through an engagement of the male and female threads. The collar 194 can be formed of a thermally conductive polymer.

One of ordinary skill in the art should appreciate that the light 10 is capable of being installed in wet environments, dry environments, and environments that vary between being wet and dry.

In some embodiments, the lens 38 can include a pivotable portion so that a user can pivot the lens for directing light to desired areas. In other embodiments, the lens 38 can be a fixed directional lens such that when the light 10 is inserted and oriented in the pipe 116 the beam direction is fixed. In such a configuration, the light 10 can be removed and re-oriented in the pipe 116 to change the beam direction. Additionally, the lens 38 can include an optic, which can be an adjustable reflective optic for example, for directional control of emitted light.

In some embodiments it is contemplated that the light body 12 can have a diameter sufficiently smaller than the inner diameter of the pipe 116, such that when the compression ring 14 is compressed, bulged outward, and engaged with the inner wall of the pipe 116, it acts as a pivot. In such an arrangement, the direction of the light 10 can be changed with the compression ring 14 acting as a pivot.

It should be understood by one of ordinary skill in the art that the pipe 116 can be an underwater circulation system pipe, or, alternatively, it can be an electrical conduit.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A light, comprising:

a body having a front end and a rear end;

a lens coupled to the body, wherein the body and the lens define a waterproof chamber;

an electronic assembly mounted in the waterproof chamber, the electronic assembly including at least one light-emitting element for emitting light; and means for mounting the light to an inner surface of a conduit, the conduit including an electrical cable for supplying electrical current to the light, wherein the means for mounting comprises:

a front housing secured to the front end of the body;

a translating retainer rotatably engaged with the front housing;

a slip ring positioned around the front housing and between the translating retainer and the front end of the body; and a compressible ring positioned around the front housing, and between the slip ring and the front end of the body, wherein rotation of the translating retainer with respect to the lens in a first direction causes the translating retainer to drive the slip ring toward the front end of the body, compressing the compressible ring between the slip ring and the front end of the body, and causing the compressible ring to bulge outward.

2. The light of claim 1, wherein the compressible ring includes abrasive teeth for increased pull-out resistance.

3. The light of claim 1, wherein the compressible ring comprises a barbed element.

4. The light of claim 1, wherein the compressible ring comprises an o-ring.

5. The light of claim 1, wherein the compressible ring comprises an adhesive.

6. The light of claim 5, wherein the adhesive is silicone based.

7. The light of claim 1, wherein the compressible ring secures to the inner diameter of a pipe or electrical conduit.

8. The light of claim 1, wherein the compressible ring forms a watertight seal with the inner diameter of the conduit.

9. The light of claim 1, wherein the compressible ring is expandable to form a watertight seal with conduits of varying inner diameter sizes.

10. The light of claim 1, wherein the translating retainer secures to a front face of the conduit.

11. The light of claim 1, further comprising a first heat sink secured to the front end of the body, and in thermal communication with the electronic assembly, wherein the first heat sink dissipates heat away from the electronic assembly.

12. The light of claim 11, further comprising a second heat sink, the second heat sink having a higher thermal conductivity than the first heat sink.

13. The light of claim 11, further comprising a water pathway placing the first heat sink in contact with water.

14. The light of claim 1, wherein the cable provides control commands to the electronic assembly.

15. The light of claim 1, wherein the electronic assembly includes a wireless transceiver.

16. The light of claim 15, wherein the electronic assembly wirelessly receives control commands through the wireless transceiver.

17. The light of claim 1, wherein the light can be installed in a wall bulk head fitting.

18. The light of claim 1, wherein the light can be installed in a dry environment.

19. The light of claim 1, wherein the light can be installed in a wet environment.

20. The light of claim 1, wherein the light can be installed in a wet environment and a dry environment.

21. The light of claim 1, wherein a thermally conductive potting compound encapsulates the electronic assembly.

22. The light of claim 1, wherein the lens includes an optic for directional control of emitted light.

23. The light of claim 1, further comprising an adjustable reflective optic for directional control of emitted light.

24. The light of claim 1, further comprising a heat-pipe that conducts heat from the electronic assembly and the light emitting element, and spreads the heat evenly throughout the body.

25. The light of claim 1, wherein the electronic assembly comprises a plurality of printed circuit boards mated using stand-off connectors.

26. The light of claim 1, wherein the electronic assembly comprises a plurality of printed circuit boards mated using edge card connections.

27. The light of claim 1, wherein the electronic assembly comprises a plurality of printed circuit boards mated using a flex tail.

28. The light of claim 1, wherein the compressible ring is configured to absorb expansion due to freezing water.

29. The light of claim 1, wherein the compressible ring comprises a hollow o-ring that can absorb expansion due to freezing water.

30. The light of claim 1, wherein the compressible ring is formed of a flexible material that can absorb expansion due to freezing water.

31. The light of claim 1, wherein the compressible ring is coated with a flexible material that can absorb expansion due to freezing water.

32. The light of claim 1, further comprising a thermal management system in communication with the electronic assembly, the thermal management system preventing operation of the electronic assembly and the light emitting element at an operational temperature exceeding component limitations.

33. The light of claim 1, wherein the lens includes one or more apertures configured to be engaged by a stationary tool for securing the lens, and the means for mounting includes one or more slots configured to be engaged by a rotating tool for rotating a portion of the means for mounting.

34. The light of claim 33, wherein the stationary tool and the rotating tool are adapted to interface with at least one of a screwdriver, wrench, ratchet, or drill.

35. The light of claim 1, wherein the light emitting element is an LED.

36. The light of claim 35, wherein the LED is one of a RGB LED, RGBW LED, white LED, or ultraviolet LED.

37. A light, comprising:

a body having a front end and a rear end;

a lens coupled to the body, wherein the body and the lens define a waterproof chamber;

an electronic assembly mounted in the waterproof chamber, the electronic assembly including at least one light-emitting element for emitting light; and means for mounting the light to an inner surface of a conduit, the conduit including an electrical cable for supplying electrical current to the light, wherein the means for mounting comprises:

a front housing secured to the front end of the body;

a translating retainer rotatably engaged with the front housing;

a slip ring positioned around the front housing and between the translating retainer and the front end of the body; and a compressible ring positioned around the front housing, and between the slip ring and the front end of the body, wherein rotation of the lens with respect to the translating retainer in a first direction causes the translating retainer to drive the slip ring toward the front end of the body, compressing the compressible ring between the slip ring and the front end of the body, and causing the compressible ring to bulge outward.

38. The light of claim 37, wherein the compressible ring includes abrasive teeth for increased pull-out resistance.

39. The light of claim 37, wherein the compressible ring comprises a barbed element.

40. The light of claim 37, wherein the compressible ring comprises an o-ring.

41. The light of claim 37, wherein the compressible ring comprises an adhesive.

42. The light of claim 41, wherein the adhesive is silicone based.

43. The light of claim 37, wherein the compressible ring secures to the inner diameter of a pipe or electrical conduit.

44. The light of claim 37, wherein the compressible ring forms a watertight seal with the inner diameter of the conduit.

45. The light of claim 37, wherein the compressible ring is expandable to form a watertight seal with conduits of varying inner diameter sizes.

46. The light of claim 37, wherein the translating retainer secures to a front face of the conduit.

47. The light of claim 37, further comprising a first heat sink secured to the front end of the body, and in thermal communication with the electronic assembly, wherein the first heat sink dissipates heat away from the electronic assembly.

48. The light of claim 47, further comprising a second heat sink, the second heat sink having a higher thermal conductivity than the first heat sink.

49. The light of claim 47, further comprising a water pathway placing the first heat sink in contact with water.

50. The light of claim 37, wherein the cable provides control commands to the electronic assembly.

51. The light of claim 37, wherein the electronic assembly includes a wireless transceiver.

52. The light of claim 51, wherein the electronic assembly wirelessly receives control commands through the wireless transceiver.

53. The light of claim 37, wherein the light can be installed in a wall bulk head fitting.

54. The light of claim 37, wherein the light can be installed in a dry environment.

55. The light of claim 37, wherein the light can be installed in a wet environment.

56. The light of claim 37, wherein the light can be installed in a wet environment and a dry environment.

57. The light of claim 37, wherein a thermally conductive potting compound encapsulates the electronic assembly.

58. The light of claim 37, wherein the lens includes an optic for directional control of emitted light.

59. The light of claim 37, further comprising an adjustable reflective optic for directional control of emitted light.

60. The light of claim 37, further comprising a heat-pipe that conducts heat from the electronic assembly and the light emitting element, and spreads the heat evenly throughout the body.

61. The light of claim 37, wherein the electronic assembly comprises a plurality of printed circuit boards mated using stand-off connectors.

62. The light of claim 37, wherein the electronic assembly comprises a plurality of printed circuit boards mated using edge card connections.

63. The light of claim 37, wherein the electronic assembly comprises a plurality of printed circuit boards mated using a flex tail.

64. The light of claim 37, wherein the compressible ring is configured to absorb expansion due to freezing water.

65. The light of claim 37, wherein the compressible ring comprises a hollow o-ring that can absorb expansion due to freezing water.

66. The light of claim 37, wherein the compressible ring is formed of a flexible material that can absorb expansion due to freezing water.

67. The light of claim 37, wherein the compressible ring is coated with a flexible material that can absorb expansion due to freezing water.

68. The light of claim 37, further comprising a thermal management system in communication with the electronic assembly, the thermal management system preventing operation of the electronic assembly and the light emitting element at an operational temperature exceeding component limitations.

69. The light of claim 37, wherein the lens includes one or more apertures configured to be engaged by a stationary tool for securing the lens, and the means for mounting includes one or more slots configured to be engaged by a rotating tool for rotating a portion of the means for mounting.

70. The light of claim 69, wherein the stationary tool and the rotating tool are adapted to interface with at least one of a screwdriver, wrench, ratchet, or drill.

71. The light of claim 37, wherein the light emitting element is an LED.

72. The light of claim 71, wherein the LED is one of a RGB LED, RGBW LED, white LED, or ultraviolet LED.

73. A light, comprising:

a body having a front end and a rear end;

a lens coupled to the body, wherein the body and the lens define a waterproof chamber;

an electronic assembly mounted in the waterproof chamber, the electronic assembly including at least one light-emitting element for emitting light; and means for mounting the light to an inner surface of a conduit, the conduit including an electrical cable for supplying electrical current to the light, wherein the means for mounting comprises:

a front housing secured to the front end of the body;

a translating retainer rotatably engaged with the front housing;

a slip ring positioned around the front housing and between the translating retainer and the front end of the body; and a compressible ring positioned around the front housing, and between the slip ring and the front end of the body, wherein compression of the lens with respect to the translating retainer causes the translating retainer to drive the slip ring toward the front end of the body, compressing the compressible ring between the slip ring and the front end of the body, and causing the compressible ring to bulge outward.

74. The light of claim 73, wherein the compressible ring includes abrasive teeth for increased pull-out resistance.

75. The light of claim 73, wherein the compressible ring comprises a barbed element.

76. The light of claim 73, wherein the compressible ring comprises an o-ring.

77. The light of claim 73, wherein the compressible ring comprises an adhesive.

78. The light of claim 77, wherein the adhesive is silicone based.

79. The light of claim 73, wherein the compressible ring secures to the inner diameter of a pipe or electrical conduit.

80. The light of claim 73, wherein the compressible ring forms a watertight seal with the inner diameter of the conduit.

81. The light of claim 73, wherein the compressible ring is expandable to form a watertight seal with conduits of varying inner diameter sizes.

82. The light of claim 73, wherein the translating retainer secures to a front face of the conduit.

83. The light of claim 73, further comprising a first heat sink secured to the front end of the body, and in thermal communication with the electronic assembly, wherein the first heat sink dissipates heat away from the electronic assembly.

84. The light of claim 83, further comprising a second heat sink, the second heat sink having a higher thermal conductivity than the first heat sink.

85. The light of claim 83, further comprising a water pathway placing the first heat sink in contact with water.

86. The light of claim 73, wherein the cable provides control commands to the electronic assembly.

87. The light of claim 73, wherein the electronic assembly includes a wireless transceiver.

88. The light of claim 87, wherein the electronic assembly wirelessly receives control commands through the wireless transceiver.

89. The light of claim 73, wherein the light can be installed in a wall bulk head fitting.

90. The light of claim 73, wherein the light can be installed in a dry environment.

91. The light of claim 73, wherein the light can be installed in a wet environment.

92. The light of claim 73, wherein the light can be installed in a wet environment and a dry environment.

93. The light of claim 73, wherein a thermally conductive potting compound encapsulates the electronic assembly.

94. The light of claim 73, wherein the lens includes an optic for directional control of emitted light.

95. The light of claim 73, further comprising an adjustable reflective optic for directional control of emitted light.

96. The light of claim 73, further comprising a heat-pipe that conducts heat from the electronic assembly and the light emitting element, and spreads the heat evenly throughout the body.

97. The light of claim 73, wherein the electronic assembly comprises a plurality of printed circuit boards mated using stand-off connectors.

98. The light of claim 73, wherein the electronic assembly comprises a plurality of printed circuit boards mated using edge card connections.

99. The light of claim 73, wherein the electronic assembly comprises a plurality of printed circuit boards mated using a flex tail.

100. The light of claim 73, wherein the compressible ring is configured to absorb expansion due to freezing water.

101. The light of claim 73, wherein the compressible ring comprises a hollow o-ring that can absorb expansion due to freezing water.

102. The light of claim 73, wherein the compressible ring is formed of a flexible material that can absorb expansion due to freezing water.

103. The light of claim 73, wherein the compressible ring is coated with a flexible material that can absorb expansion due to freezing water.

104. The light of claim 73, further comprising a thermal management system in communication with the electronic assembly, the thermal management system preventing operation of the electronic assembly and the light emitting element at an operational temperature exceeding component limitations.

105. The light of claim 73, wherein the lens includes one or more apertures configured to be engaged by a stationary tool for securing the lens, and the means for mounting includes one or more slots configured to be engaged by a rotating tool for rotating a portion of the means for mounting.

106. The light of claim 105, wherein the stationary tool and the rotating tool are adapted to interface with at least one of a screwdriver, wrench, ratchet, or drill.

107. The light of claim 72, wherein the light emitting element is an LED.

108. The light of claim 107, wherein the LED is one of a RGB LED, RGBW LED, white LED, or ultraviolet LED.

* * * * *